US006053511A

United States Patent [19]

Intengan

[11] Patent Number: 6,053,511

[45] Date of Patent: Apr. 25, 2000

[54] NON-POSTURAL CHANGE TWO FEET BRAKING FOR ROLLER SKATES

[76] Inventor: Franklin Sanchez Intengan, 17831 NW., 79th Pl. Palm Springs North, Miami, Fla. 33015

[21] Appl. No.: 08/988,557

[22] Filed: Dec. 11, 1997

[51] Int. Cl.[7] ..... A63C 17/14

[52] U.S. Cl. ..... 280/11.2; 280/11.22; 188/5

[58] Field of Search ..... 188/5; 280/11.2, 280/11.22

[56] References Cited

U.S. PATENT DOCUMENTS

| | | | |
|---|---|---|---|
| 5,143,387 | 9/1992 | Colla | 280/11.2 |
| 5,171,033 | 12/1992 | Olsen et al. | 280/11.22 |
| 5,388,844 | 2/1995 | Pellegrini, Jr. et al. | 280/11.2 |
| 5,439,238 | 8/1995 | Neal | 280/11.2 |
| 5,590,889 | 1/1997 | Pozzobon | 280/11.2 |
| 5,609,346 | 3/1997 | Bellehumeur | 280/11.2 |
| 5,647,599 | 7/1997 | Visger et al. | 280/11.2 |
| 5,651,556 | 7/1997 | Mitchell | 280/11.2 |

*Primary Examiner*—Brian L. Johnson
*Assistant Examiner*—Deanna Draper
*Attorney, Agent, or Firm*—Oltman, Flynn & Kubler

[57] ABSTRACT

A roller skate provided with a brake mechanism operable when the foot or feet of the skater inside the boots are arctuated to an arch from the normal straight position inorder to effect braking. The braking system allows the skater to perform a single foot or two feet braking at will without changing the skater's postural position at the point of time when the brake was applied. It capitalize on the principle that when the foot or feet inside the boots are arctuated, they behave like structural arches to designed that when subjected to vertical loads, the feet end supports (namely the heels and phalanges ends) exerts reaction forces with inwardly directed components. It is stable and strong. The highest point or its crown, and the point which has the biggest movement, falls somewhere between the tarsus and metatarsus zones of its respective foot. Preferably, it is crown movement that is being used to drive a brake means inorder to create an effective and controllable braking. The present invention has utilized this principle in alliance with a brake means of the type that force amplifying to ensure a good margin of effective efficiency.

10 Claims, 2 Drawing Sheets

NON-POSTURAL CHANGE TWO FEET BRAKING FOR ROLLER SKATES

BACKGROUND OF THE INVENTION

1. Field of the Invention

The present invention relates to brake system of either the in-line type roller skates or the classic adjacent-wheel type, which allows the rider to effectively apply at will two-feet braking without any postural change at that time time the brake was applied by arcuating the skater's feet.

It is paramount for roller skates to safely and effectively brake to stop as it is to roll smooth and swift. However, to date the publicly adapted brake system commercially popular are the ideas that were conceived in the late 40's and late 50's, such as the brake means mounted to front end of the roller skates or simply called as the Toe-Stop and for the in-line skate is the rear mounted brake means sometimes called as the Heel-Pad.

There are quite a number of patents describing otherways of braking, but the fact of the matter is that the absolute judge in the field of success is the general public itself that celebrates the idea's undisfutable commercial adoption.

2. Description of the Prior Art

Indeed the braking mechanism of a roller skate is very important to control safely skating operation. The art has documented various braking mechanism, One advocate in the roller skates brake arts is the U.S. Pat. No. 5,143,387 by Jeff M. Colla entitled Roller Skate Brake Assembly Having Toe Actuator Within the Boot. His idea is advocating the Toe to actuate an actuator that is in operative relation with a brake pad to engaged directly against the wheel to effect braking. The biggest drawback of Mr. Colla's idea is the fact that the Toe itself simply and beyond any reasonable doubt has "NO" enough power to effectively brake the gross weight of the skater under accelerated or even a deccelerated momentum. On the first place, He is claiming a brake actuator means and not a force amplifying brake means, but even if he did!, the Toe has simply no enough force even when amplified by a brake force amplifying means to practically cause a controllable and effective braking. This is the prime-reason why the skate Manufacturers did not venture with Mr. Colla's idea inspite of the fact that it was available since 1991.

In 1958, Levin under U.S. Pat. No. 2,865,645 advocated a spring and nut mounted on the rear axis of the skate with which one could adjust pressure and in effect the drag on the rear wheel bearings.

In 1973 Roddy patented U.S. Pat. No. 3,734,244 that produced the same result as that of Levin by putting a drum brake directly on the wheel. In 1975, U.S. Pat. No. 3,900,203 by Kukulowicsz presented a single plate that bears on two adjacent tandem wheels. U.S. Pat. No. 4,394,028 introduced a brake system where a wheel was attached to the rear of the skate at a level slightly above that of the usual wheel, in such a way that its rolling surface touches the ground when the skate is tilted back.

Further, in 1971 under U.S. Pat. No. 3,580,595 advocated a method of attaching a toe stop to an inexpensive street skate while U.S. Pat. No. 4,319,759 by Neitz introduced an addition of a pin to the toe stop to prevent rotation to the pad.

In 1981 U.S. Pat. No. 4,295,547 by Dungan presented hydraulic type for small vehicles; by 1990 Gates under U.S. Pat. No. 4,943,075 advocated similar but differentiating way.

Still further, Wagers in 1959 under U.S. Pat. No. 2,872,201 introduced a system by attaching the pad to the structure of the skate. Then in 1963 under U.S. Pat. No. 3,112,119 advocated the heel of the shoe itself as part of the main plate of the skate. But still further, more refinements were introduced in 1991 by Olson under U.S. Pat. No. 5,052,707 and U.S. Pat. No. 5,067,736 using plastic webs and wear indicator. All previous patents to date excepting those that uses either the Toe or Heel brake system in short, failed to gain confidence to the world skates manufacturers and therefore all lost its commercial goals.

The Toe or Heel Skate brake system has still so much need for improvement, because even with its adaption by the general public, they are the primary causes of roller skating accidents. Their disadvantages according to those who are skilled in the art varies. For example, they do not allow intermittent application of brake. In the Toe brake system, the weight of the skater that is extended therefore the braking force induced is limited. Further, in the Toe brake system, the skater has to slant his body slightly forward to move the center of gravity to the front portion of his body and such awkward body position could easily render the skater unbalanced.

In the Heel system skate brake, as the skater pushes down on the heel of the skater, the skaters weight tends to be supported primarily on the freely rolling wheel, and to bring the brake pad on the heel portion to bear, the skater must raise the Toe portion of the skate into the air while keeping the heel pad engaged on the rolled surface. It is at this necessary motional transition of the skaters balance at this precise moment, that the skater could totally lost its balance and falls down.

It is thus an object of the present invention to provide a roller skate that the skater can apply two feet braking at will without any positional change at the precise point when the braking effort is made and therefore able to maintain balance and very effective controllable braking the fact that such braking effort could now be made with the skater's two feet simultaneously.

It is another object of the present invention to include a force amplifying brake means inorder to produce a safety margin of braking force to produced an effective but controllable braking.

It is finally an object of the present invention to include a brake system that can be intermittently and incrimentally operated at will as the skating condition requires.

SUMMARY OF THE INVENTION

The present invention attains or fullfills the above objectives, as weel as others, as maybe determined by equitable or impartial reading and elucidation of the entire specification.

A roller skate is provided including a boot and a base consisting of front portion and rear portion connected by concave mediate portion. Preferably, the base front and rear portions should lie in conincidence with the same horizontal plane, so that when the boot is rigidly attached to the base, the heels and soles of the skater's feet will lie also in horizontal plane thereof and parallel to the ground. This will make it easy for the skater to arctuate his or her feet on the supporting surface inside the boot from the normal straight position for braking.

Alternately, the base includes two side brackets extending from its rear to front portions where plurality of inline wheels are mounted for rotation about a horizontal axis, rotating in the same vertical plane.

Pivoting about a horizontal axis at the rear portion of the base is a brake means including a brake pad for engagement against the ground surface to effect braking when it is pivoted down. The brake means includes two uneven arms extending with the vertical planes and centralizing the thickness of the base by its side brackets thereof. The end portion of the short arm is provided with a hole in a horizontal axial orientation and concentric to the holes passing thru the base side brackets and thru the long arm of the brake means in the opposite side so that a pin maybe engaged thru as pivotal axis of the brake means. The long arm of the brake means extends from the pivotal pin to the mid-portion between the heel and the toe thereof, under the boot and along-side the base side bracket whereby the long arm's end portion is preferably provided with a connecting means for connection to one end of a belt assembly means looping-over thru a pad saddled on the top portion of the skater's feet preferably around the feet's tarsus and metatarsus zones; the other end portion of the belt assembly means is rigidly fastened under the sole of the boot beside the smallest or fifth phalange of the skater's feet.

The boot is provided with sufficient opening around the area where the belt pad is saddled-on inorder to allow the skater to arched his or her feet at will to effect braking. If the boot comes with a liner, said opening should also extend to the liner in the same location. When the skater wants to brake, he or she will just at will and without changing posture at that point of time, arched one foot or both feet simultaneously to effect braking.

The spirit and soul of the idea revolves around the use of the entire feet movement and more particularly the feet arching. When the foot is arcuated, all the articulated bones comprising the human feet becomes a structure curved and so formed that when it is subjected to vertical load (like the weight of the skater), its two end supports, namely the heel and the toes, exerts reaction forces with inwardly directed horizontal components, therefore very stable and strong. In otherwords, the supports are able to exert lateral as well as vertical forces, to resist the action of any applied loads. These lateral forces are in the nature of thrust which acts inwardly toward the center of the arch span. The highest point of the arch is called the crown and this falls-in around the tarsus and metatarsus zones of the feet. It is thus, the maximum up & down movement of the crown that the spirit, soul and scope of the idea is capitalizing. This movement can really drive infinite number of applications. However, as strong and as stable the crown movement is already, still, the present invention utilized this force in co-operation with a force amplifying lever type brake means in order to assure a good margin of controllability and effectivity of skate braking without any postural change of the skater when the brake is applied.

Numerous other objects, advantages, and features of the invention will be apparent to those skilled in the art from the following discussion taken in conjunction with the following drawings.

DETAILED DESCRIPTION OF THE PREFERRED EMBODIMENTS

Figure 2B:
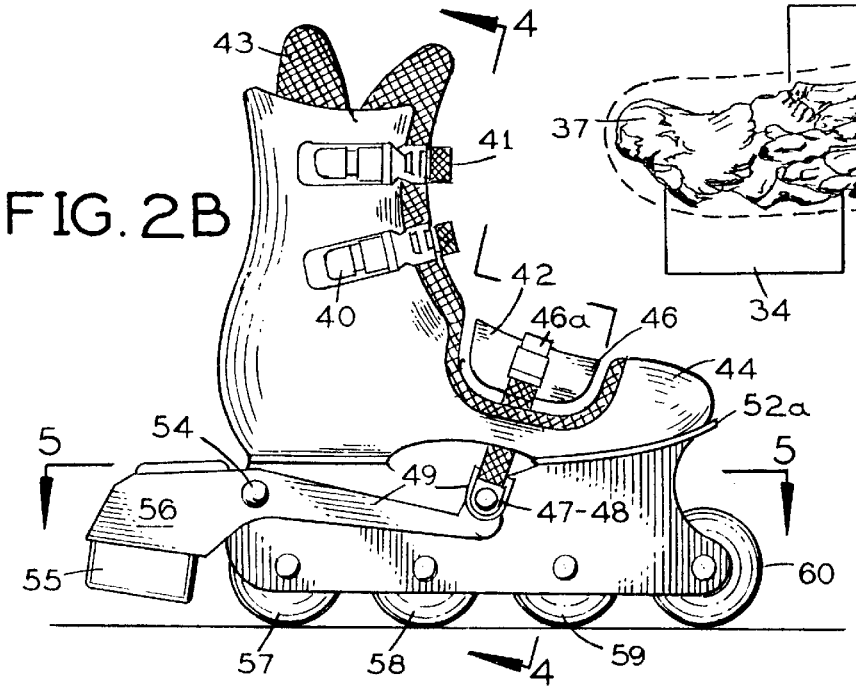
FIG. 2B is a side view of a left foot inline skate of the present invention with the left foot of a skater inside the boot in normal position as shown in FIG. 2A (Notice that the brake pad is not engaged to the rolled-on surface)

As per requirement, the described embodiments of the present invention are disclosed; nevertheless, is to be understood that the divulged embodiments are merely exemplary of the invention which maybe compriced in various forms. Hence, particular functional and structural details should not to be understood as limitation, but merely as a basis for the claims and as a general character for teaching one skilled in the art to broadly employ the present invention in practically any suitable detailed structure.

Referring to the drawings, like attributes and characterestics of the present invention shown in various FIGURES are indicated by the same reference numerals.

First Preferred Embodiment

Ascribing to the drawings and primarily to FIGS. 1 through 3B, in accordance with the invention, a roller skates 20 chiefly includes a boot 44 rigidly mounted to a base from the base front portion 52*a* and rear portion 52*b* thereof and preferrably such that the hell and sole of the skater's feet when inside the boot will be parallel to the ground or rolled-on surface. The base includes two side-brackets 51*a* and 51*b* extending from the base front and rear portions where plurality of in-line wheels 57, 58, 59, 60 are mounted for rotation about a horizontal axis and rotating in the same vertical plane. The boot 44 maybe provided mainly of belt and buckle means 40 and 41 preferrably oriented above ankle to snugly and comfortably fastened the roller skates 20 to the skaters feet. A liner 43 maybe provided inside the boot to cushion the skater's feet inside the boot 44. Both the liner 43 and boot 44 are provided with sufficient opening preferrably above the tarsus 34 and metatarsus 35 of the skater's feet inside the boot 44, inorder to allow the skater's feet to arcuate at will to effect braking. See FIGS. 1, 2A & 3A.

Figure 1:
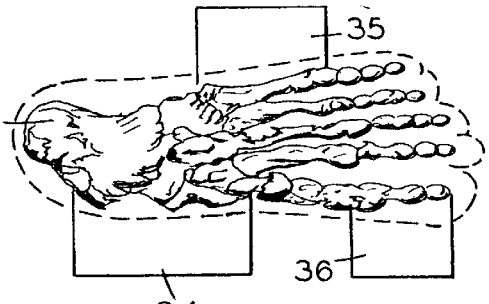
FIG. 1 is a skeletal top view of a left human foot representing the left foot of a skater, showing the different types of articulated or jointed bones.
Figure 3A:
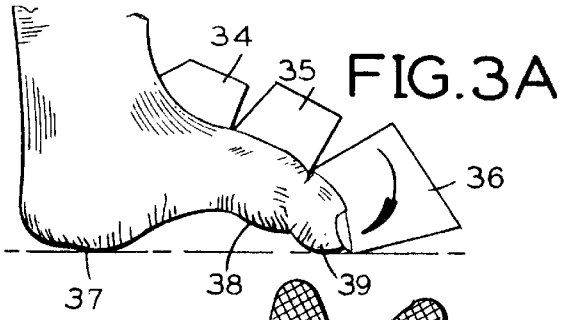
FIG. 3A is a side view of a left human foot representing the left foot of a skater shown in FIG. 2A which is now in an arcuated position for braking and featuring the skater's foot position inside the boot as shown in FIG. 3B.
Figure 2A:
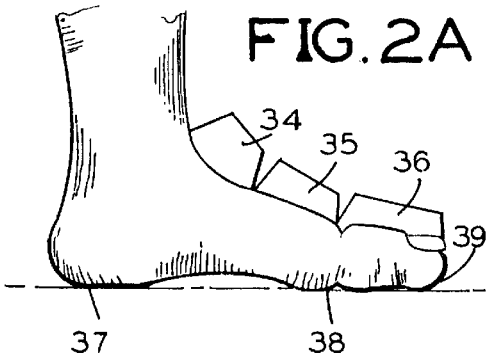
FIG. 2A is a side view of a left human foot representing the left foot of a skater, featuring its normal position inside the boot of an inline skate portrayed in FIG. 2B.
Figure 3B:
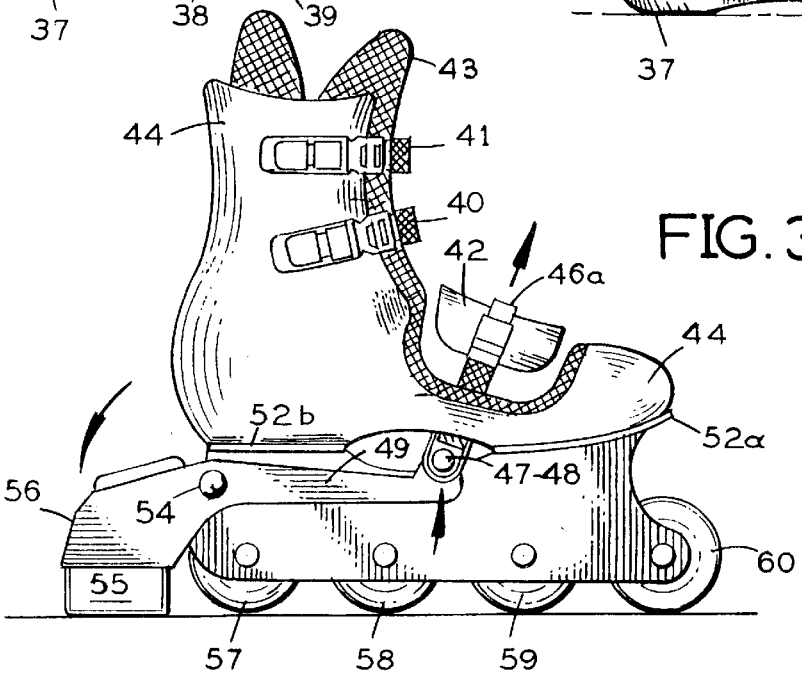
FIG. 3B is a side view of a left foot inline skate of the present invention when the skater's foot inside the boot is arcuated for braking as featured in FIG. 3A (Notice that the brake pad is now engaged to the rolled-on surface to effect braking)
Figure 4:
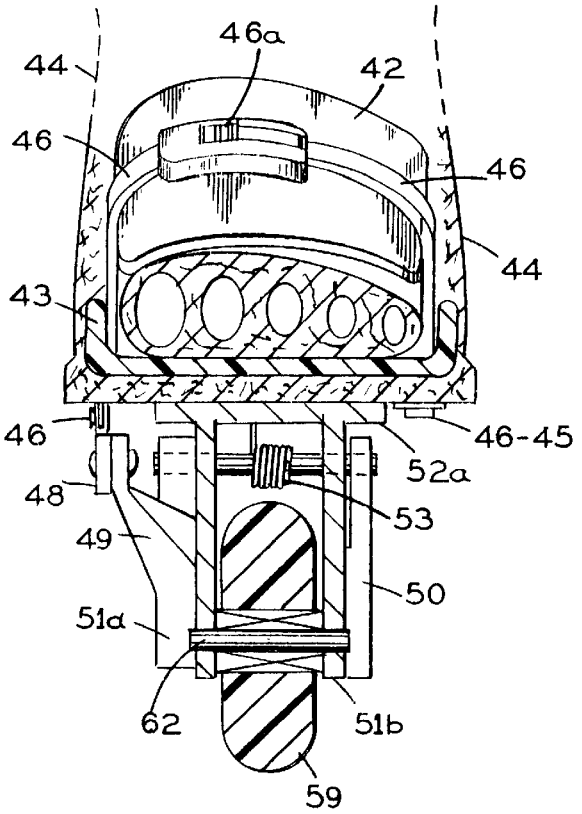
FIG. 4 is a crossectional view taken from line 4—4 of FIG. 2B of the present invention.
Figure 5:
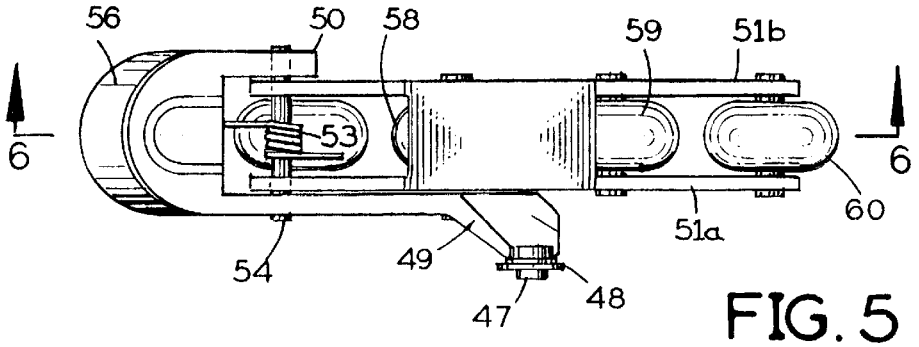
FIG. 5 is a top crossectional view taken from line 5—5 of FIG. 2B of the present invention.
Figure 6:
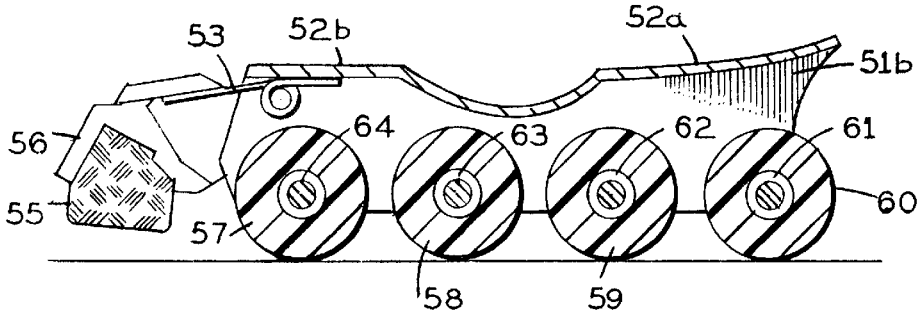
FIG. 6 is a side crossectional view taken from line 6—6 of FIG. 5 of the present invention.

FIG. 1 is a skeletal top view of the skater's left foot generally divided into three zones, tarsus 34, metatarsus 35 and phalanges 36. The tip of the phalanges 36 are the toes or digits 39. When the foot is supported by a supporting surface, it is primarily supported through its heel 35 and sole 38 extending to the digits 39. FIG. 2A represent the skater's left foot position inside the boot 44 shown in FIG. 2B. When the skater desires to brake at will, the skater simply arctuate his or her foot or feet simultaneously as shown in FIG. 3A. By this action, the skater's foot or feet will arched and the center of this arch or crown is the point of highest movement that falls somewhere between the tarsus 34 and metatarsus 35 zones. At this precise moment, the balance of the skater regardless of whatever his or her postural position at that point of time is never compromised because the skater's center balance is still in complete equilibrium even with the transitional feet motion from FIG. 2A to FIG. 2B. It is therefore the movement of the entire foot or feet as a whole when being arctuated is being utilized by the present invention to drive a brake means inorder to induced an effective braking. Since the highest movement of this arched foot or feet is at the arch crown and falls directly between the tarsus 34 and metatarsus 35, a saddle means 42 is saddled over these said zones on the skater's feet inorder to transmit a driving movement to drive the said brake means. FIG. 3A therefore is the feet or foot position of the skater inside the boot when braking.

Referring to FIGS. 2B, 3B, 4, 5 and 6, a brake means thereof is provided oriented at the rear portion of the base and particularly position to pivot about a horizontal axis 54 through the base side brackets 51*a* and 51*b* and parallel to the rotational axis of the wheels. The brake means may comprise a head 56 provided with brake pad 55 designed to engaged flat on the rolled-on surface when the brake means is actuated. Leading the head 56 are the short-arm 50 and long-arm 49 extending thereof from said head 56 and having the gap between these arms engaging parallel to the sides of the side-brackets 51*a* and 51*b*. At the end of the short-arm 50, a through concentric holes runs transversely to the rotational plane of the wheels and parallel to the axis of rotation of said wheels, from the short-arm through the side-brackets and finally through the long-arm 49 where a pivot pin maybe provided to hold the brake means in place and to function as the pivotal axis 54 of the said brake means. The long arm 49 extends much longer from the pivotal axis 54 as compared to the length from said pivotal axis 54 to the head 56 inorder to act as an amplifying leverage when an actuating force is made to drive the end portion of the long-arm 49 for braking.

A washer-plate 48 connected to one end of a belt and buckle assembly 46 is connected to the end portion of the long-arm 49 through a pin 47. With a through hole provided on the boot sole along-side the big-phalange, the belt and buckle assembly 46 is being threaded through this said hole and loops around over the saddle 42 which is resting on top of the foot surface between the tarsus 34 and metatarsus 35 zones, and continues to loop-down and through another opening of the boot sole along-side the smallest phalange where its end portion is rigidly anchored to the boot sole by an anchoring means 45. The buckle portion 46*a* of the belt and buckle assembly 46 is positioned by design to be on top and mid-surface of the saddle 42 for adjustment accessability when the brake means is fastened to the foot or feet of the skater. A biasing torque spring 53 is mounted concentric to the pin at the pivotal axis 54 in order to disengage the brake pad 55 from engaging against the rolled-on surface when the foot or feet inside the boot 44 are returned to the straight normal position as described in FIGS. 2A and 2B.

By virtue of the preceding possible way of braking arrangement, the Skater therefore can simply, easily and conveniently apply effective braking at will by arcuating his or her foot or feet inside the boot and without any change of the skater's postural position at that point of time that the skater applied the brake. The present invention freshly unveiled a brake system that will allow a skater to apply two feet braking not possible from its predecessors.

With the invention thus explained, it is apparent that various modification and variations can be made without departing from the spirit and scope of the invention. It is intended that the invention be limited as indicated in the appended claims.

What I claim is:

1. A skate comprising:

a boot having a boot sole, a boot rearward portion for containing a wearer ankle and having a boot forward portion for containing a wearer tarsus, metatarsus and phalanges, said boot forward portion having a boot upper region extending over a wearer metatarsus, said boot upper region having an upper region opening for exposing a wearer metatarsus;

a wheel retaining frame secured to said boot along and underneath said boot sole, said wheel retaining frame containing a plurality of skate wheels rotatably secured in a series extending along said boot sole from said boot rearward portion to said boot forward portion, said wheels resting on the ground;

brake means comprising foot saddle means extending across said upper region opening, a long arm structure extending beside said wheel retaining frame substantially from said boot rearward portion toward said boot forward portion, said long arm structure having a long arm structure middle region pivotally secured to a pivot axis element extending laterally from said wheel retaining frame, said long arm structure having a long arm structure rearward segment comprising a generally downwardly directed brake engagement element and having a frame forward end connected to a strap means extending to and engaging said foot saddle means;

such that pivoting the wearer phalanges of a wearer foot contained within said boot downwardly and thereby arching the wearer metatarsus upwardly elevates said saddle means relative to said wheel retaining frame and thereby pulls said strap means upwardly to raise the long arm structure forward end, thereby pivoting the long arm structure rearward end and said brake engaging element downwardly against the ground.

2. The skate of claim 1, additionally comprising a torque spring connected to said pivot element and to said wheel retaining frame, such that said torque spring biases said long arm structure to pivot the long arm structure rearward end upwardly and off the ground, the biasing of said torque spring being overcome by the arching the wearer metatarsus upwardly when said brake means is operated to stop said skate from rolling forward on said wheels.

3. The skate of claim 1, wherein said wheel retaining frame means comprises two parallel and laterally spaced apart side brackets, said side brackets having directly opposing wheel axle ports, each pair of opposing said wheel axle ports containing an axle with one said wheel mounted on said axle between said side brackets.

4. The skate of claim 1, wherein said saddle means comprises a sheet of flexible material for wrapping over the top of a wearer metatarsus.

5. The skate of claim 4, wherein said sheet of flexible material extends within and substantially fills said upper region opening.

6. The skate of claim 1, wherein said boot comprises a forward slit for opening said boot for admitting the wearer foot into said boot, said forward slit including buckle means for pulling said slit closed for securing said boot around a wearer foot.

7. The skate of claim 1, additionally comprising strap pivot means interconnecting said strap means and said long arm structure forward end permitting said strap means and said long arm structure to pivot relative to each other during saddle means elevation.

8. The skate of claim 1, additionally comprising a boot liner contained within said boot for increasing wearer foot comfort while said boot is fitted around the wearer foot.

9. The skate of claim 1, wherein said brake engagement element is a brake pad.

10. A skate comprising:

a boot having a boot sole, a boot rearward portion for containing a wearer ankle and having a boot forward portion for containing a wearer tarsus, metatarsus and phalanges, said boot forward portion having a boot upper region extending over a wearer metatarsus, said boot upper region having an upper region opening for exposing a wearer metatarsus;

a wheel retaining frame secured to said boot along and underneath said boot sole, said wheel retaining frame containing a plurality of skate wheels rotatably secured in a series extending along said boot sole from said boot rearward portion to said boot forward portion, said wheels resting on the ground;

brake means comprising foot saddle means extending across said upper region opening, a long arm structure extending beside said wheel retaining frame substantially from said boot rearward portion toward said boot forward portion, said long arm structure having a long arm structure middle region pivotally secured to a pivot axis element extending laterally from said wheel retaining frame, said wheel retaining frame having a frame rearward segment comprising a brake engagement element and having a frame forward end connected to a strap means extending to and engaging said foot saddle means;

such that pivoting the wearer phalanges of a wearer foot contained within said boot downwardly and thereby arching the wearer metatarsus upwardly elevates said saddle means relative to said wheel retaining frame and thereby pulls said strap means upwardly to raise the long arm structure forward end, thereby pivoting the long arm structure rearward end and said brake engaging element to cause braking of said skate.

* * * * *